US005673857A

United States Patent [19]

Meroni et al.

[11] Patent Number: 5,673,857

[45] Date of Patent: Oct. 7, 1997

[54] DISCHARGE NOZZLE FOR CONTINUOUS CASTING

[75] Inventors: Umberto Meroni, Udine; Bruno Gosparini, Dignano; Giovanni Coassin, Pordenone, all of Italy

[73] Assignee: Danieli & C. Officine Meccaniche SpA, Buttrio, Italy

[21] Appl. No.: 453,814

[22] Filed: May 30, 1995

[30] Foreign Application Priority Data

May 30, 1994 [IT] Italy ..... UD94A0089

[51] Int. Cl.[6] ..... B05B 1/26

[52] U.S. Cl. ..... 239/524; 239/518

[58] Field of Search ..... 239/518, 524, 239/552, 568, 556, 561, 504, 597–599; 164/337, 134, 335, 437; 222/606, 607, 591

[56] References Cited

U.S. PATENT DOCUMENTS

| | | | |
|---|---|---|---|
| 3,459,346 | 8/1969 | Tinnes | 266/207 |
| 3,669,181 | 6/1972 | Schrewe | 164/281 |
| 3,995,682 | 12/1976 | Fekete et al. | 164/281 R |
| 4,671,433 | 6/1987 | Podrini | 222/606 |
| 5,227,078 | 7/1993 | Augustine | 222/606 |

OTHER PUBLICATIONS

"Basics of Casting" published in Jul. 1977.

*Primary Examiner*—Robert J. Oberleitner
*Assistant Examiner*—C. T. Bartz
*Attorney, Agent, or Firm*—Antonelli, Terry, Stout & Kraus, LLP.

[57] ABSTRACT

Discharge nozzle (10) for continuous casting of slabs having narrow sides between about 30 and about 300 mm. wide, which is employed to distribute liquid metal in a continuous casting mould and is of a type comprising a substantially vertical discharge pipe (11), which is closed at its lower end and includes lateral terminal discharge holes (14) facing towards the narrow sides of the mould and cooperating with means (13) that distribute and deflect the flow of liquid metal, the discharge pipe (11) comprising a first segment (11*a*) having a downwardly converging circular cross-section and a second downwardly diverging segment (11*b*) with a cross-section which can be varied progressively from circular to substantially rectangular at least with rounded short sides, the distribution and deflection means (13) consisting of two distribution chambers (15), one per each lateral discharge hole (14), the chambers (15) being open at their upper (16*a*) and lower (16*b*) portions and being defined by a sidewall (17) which, at the opposite side of the lateral discharge hole (14), is conformed as a downwardly diverging deflector (18) forming an angle "α" with the vertical between 10° and 35°, the lateral discharge holes (14) being adjacent to a bottom end wall (12) and having an overall section about equal to the section of the outlet of the second segment (11*b*) of the discharge pipe (11), each distribution chamber (15) defining an upper discharge outlet (16*a*) and a lower discharge outlet (16*b*).

17 Claims, 2 Drawing Sheets

DISCHARGE NOZZLE FOR CONTINUOUS CASTING

BACKGROUND OF THE INVENTION

This invention concerns a discharge nozzle for continuous casting.

The discharge nozzle for continuous casting according to the invention is employed in cooperation with a crystalliser to produce slabs having a thickness (narrow side of the slab) between about 30 mm. and about 300 mm.

The continuous casting of conventional, medium-sized and thin slabs entails a problem linked to the disturbances caused by the liquid metal leaving the discharge nozzle below the meniscus within the casting chamber of the crystalliser.

The discharge nozzle is associated with a tundish and is positioned with its downstream terminal portion sunk below the meniscus of the liquid metal contained in the casting chamber of the crystalliser.

So as to obviate problems linked to the high speed discharge of the liquid metal into the casting chamber, discharge nozzles have been disclosed which have their bottom end closed and in which their discharge holes are positioned in the sidewalls of the discharge nozzle; these discharge holes advantageously face the narrow sidewalls of the casting chamber.

The discharge nozzles of the state of the art involve problems linked to the high speed of discharge of the liquid metal through the lateral discharge holes.

To be more exact, the jets of liquid metal emerging laterally continue their path up to the sidewall of the crystalliser and scour the narrow sidewalls of the crystalliser.

This scouring of the narrow sidewalls of the crystalliser causes, on the one hand, a re-melting of the skin of the slab being formed, the skin being still very thin at this point, and generates, on the other hand, disturbances which prevent the formation and growth of that skin.

These disturbances lead to faults in the surface of the slab, such as cracks, hollows, irregular marks due to the oscillations and the incorporation of the lubricating powders.

These jets of liquid metal can cause breakages of the skin with resulting damage to the slab and also stoppages of the casting process.

The discharge nozzles of the state of the art, the lateral discharge holes of which face upwards, entail a problem linked to the excessive disturbance of the level of the meniscus, whereby the lubricating powders covering the meniscus are drawn partly into the slab.

It is also known that even by facing upwards the lateral discharge holes the problems are not eliminated which concern the erosion of the skin of the slab by the jets of liquid metal leaving the lateral discharge holes inasmuch as these jets of liquid metal retain their quantity of motion and therefore tend to continue their downward path in the core of the still fluid slab rather than moving towards the meniscus.

FR-A-2.243.043 discloses a tubular discharge nozzle with a closed bottom end and with lateral discharge holes; this nozzle is associated with a containing housing, which is open upwards and downwards and comprises deflection walls positioned at a given distance from the discharge holes of the nozzle.

The housing has a rectangular section with its sides parallel to the sidewalls of the crystalliser.

This containing housing defines an undisturbed chamber in which the jets of fluid metal meet the deflection walls after a free, straight path of about 100 mm., but advantageously 200 mm., before being deflected upwards or downwards.

These deflection walls may be parallel and vertical, or may converge upwards or downwards according to the zone where it is desired to have a preferred discharge.

The transverse discharge holes too of the nozzle may have a horizontal axis or an axis inclined upwards or downwards to distribute the jets of fluid metal preferably upwards or downwards.

This type of discharge nozzle involves also the problem that the size of the lateral discharge holes is modest in relation to the section of the tubular discharge nozzle, which makes possible a fast rate of flow of the liquid metal cast.

Therefore, the jets of liquid metal leaving the lateral discharge holes possess a great kinetic energy, which is only partly dispersed by their impact against the deflector walls.

The deflected jet of liquid metal therefore still proceeds at a very high speed upwards and/or downwards and causes disturbances in the casting chamber which do not permit a proper solidification of the skin of the slab. Moreover, these disturbances agitate the lubricating powders and cause inclusions of those powders.

Furthermore, it is known that at the central zone below the discharge nozzle, more exactly at the bottom of the tubular pipe, a cold zone is formed owing to an uneven and non-homogeneous discharge of the liquid metal, which is deflected by the deflection walls of the containing housing.

This lack of homogeneity of temperature within the molten metallic mass generates defects which prevent the finished product conforming to the desired characteristics.

Besides, the discharge nozzle disclosed in the above patent possesses a great mass which, above all in the production of thin slabs having a thickness between 60 mm. and 130 mm, may be readily incorporated in the solidifying slab with resulting damage to the discharge nozzle and to the slab.

Moreover, the overall bulk of that discharge nozzle is such that it prevents proper circulation of the liquid metal in the crystalliser and at the sides of the nozzle, with consequent overheating or excessive cooling of some zones and with resulting defects in the formation of the slab.

The deflection walls of the containing housing in that discharge nozzle are much higher than the dimensions of the lateral discharge holes, which are positioned advantageously in the upper half of the deflector walls.

Therefore, the jets of liquid metal leaving the containing housing are guided along a given distance by the deflector walls and are therefore not free to mix with the mass of the liquid metal surrounding the nozzle, thus creating zones of different temperatures.

U.S. Pat. No. 3,669,181 too discloses a tubular discharge nozzle with a closed bottom end and with lateral discharge holes, the nozzle being associated with means which deflect the jets of liquid metal.

These deflector means converge upwards and are inclined to the vertical by an angle between 10° and 45° in such a way that the upper edge of the deflector means is separated from the central tubular pipe by a distance between 5 mm. and 40 mm. so as to define an upper slit.

This type of discharge nozzle not only entails the same problems as those disclosed above but involves the further drawback that the upper slit, owing to its modest dimensions, can be readily blocked by deposits of alumina.

As a result of the blockage of the upper slit the jet of liquid metal is wholly deflected downwards, and this situation leads to solidification of the meniscus and the subsequent stoppage of the casting process owing to adhesion of the metal due to lack of lubrication of the sidewalls by the powders, which can no longer melt.

SUMMARY OF THE INVENTION

The present applicants have designed tested and embodied this invention to overcome the shortcomings of the state of the art and to achieve further advantages.

The purpose of this invention is to provide a discharge nozzle for continuous casting of slabs which is able to discharge a great rate of flow of liquid metal into the casting chamber of the crystalliser without scouring the skin of the solidifying slab in the mould and without creating disturbances in the solidifying mass of liquid metal.

The invention tends also to keep the temperature of the liquid metal in the crystalliser homogeneous.

The discharge nozzle according to the invention comprises a substantially vertical discharge pipe, which has its bottom end partly closed and includes in its lower portion lateral discharge holes arranged opposite to each other and facing towards the narrow sidewalls of the crystalliser.

The lateral discharge holes in the discharge nozzle according to the invention are positioned adjacent to the bottom end wall of the discharge pipe, to which they are connected by lead-ins.

Each of the lateral discharge holes cooperates with means which distribute and deflect the flow and which define for each lateral discharge hole a distribution chamber, which is open upwards and downwards to define an upper discharge outlet and a lower discharge outlet respectively.

Each distribution chamber is associated with a relative discharge hole, and the vertical median plane of the discharge nozzle coincides with the median plane of the distribution chambers and is placed in the vicinity of the vertical median plane of the crystalliser.

Each distribution chamber has a substantially semi-elliptic section on the horizontal plane.

According to a variant each distribution chamber has a section with parallel sides rounded at their ends.

According to a further variant the sides of each distribution chamber are tapered towards the outside.

Each distribution chamber includes a sidewall conformed as a deflector and located opposite to the relative discharge hole; these deflector sidewalls diverge outwards in the downward direction so as to form an angle to the vertical ranging from 10° to 35°, but advantageously between 15° and 25°.

The lateral discharge holes in the discharge nozzle according to the invention have a height substantially the same as the height of the respective distribution chamber.

According to a variant the height of the distribution chambers may reach 1.25 times the height of the discharge holes.

The jet of liquid metal in the discharge nozzle according to the invention is distributed partly upwards through the upper discharge outlet and partly downwards through the lower discharge outlet.

The jets of metal deflected upwards and downwards respectively emerge as free jets from the upper and lower respective discharge outlets and can be mixed with the surrounding liquid metal as soon as they emerge from the distribution chambers through the relative discharge outlets.

According to a first embodiment of the invention the deflectors are fitted with their upper and lower ends at the same level as the upper and lower edges of the respective lateral discharge holes.

According to another embodiment of the invention each deflector has its lower edge substantially at the same level as the lowest point of the lateral discharge hole.

According to yet another embodiment of the invention each deflector has its upper edge substantially at the same level as the highest point of the lateral discharge hole.

The better mixing achieved with the invention enables a more uniform temperature to be obtained within the mould and therefore emerging slabs with better properties to be produced.

Moreover, with the discharge nozzle according to the invention a correct inflow of liquid metal to the meniscus is accomplished in such a way as to prevent any inclusions in the metal from being wholly incorporated in depth therein.

Besides, the bland inflow of liquid metal to the meniscus assists the melting of the powders.

The discharge pipe in the discharge nozzle according to the invention includes a first upper segment with a substantially circular cross-section converging downwards and a second diverging segment with a cross-section progressively variable from circular to substantially rectangular with its narrow sides advantageously rounded.

This development with a variable cross-section has the twofold purpose of increasing the rate of flow of liquid metal which can be discharged through the discharge nozzle with the creation of a venturi effect, and also of slowing down progressively the flow of liquid metal poured through the nozzle so as to reduce the kinetic energy of the jet of metal.

The second segment includes in its narrow sides at its lower end portion the two lateral discharge holes having a substantially elliptic section arranged with its major axis vertical.

The overall throughput area defined by the lateral discharge holes is at least equal to, but advantageously greater than, the final cross-section of the discharge pipe.

Thus, the liquid metal flowing through the discharge pipe slows down progressively during its descent in the discharge pipe and slows down still further when flowing out through the lateral discharge holes.

In this way the kinetic energy of the liquid metal is already partly dispersed during the descent of the metal through the discharge pipe and is almost wholly dispersed thereafter when the jet of liquid metal cooperates with the deflectors of the distribution chamber.

With the discharge nozzle according to the invention it is therefore possible to obtain a flow of liquid metal leaving the nozzle at a discharge speed such as to prevent the formation of disturbances in the mould and the scouring of the sidewalls of the crystalliser by that flow with a resulting damage to the skin of the solidifying slab.

Moreover, the rate of flow of liquid metal delivered upwards through the upper discharge outlets is such as to ensure a temperature suitable to dissolve the layer of lubricating powders and oxidising agents covering the meniscus but without creating turbulence.

In the discharge nozzle according to the invention the wall at the bottom end of the discharge pipe is as long as or longer than the final outlet width of the discharge pipe.

This bottom end wall has its upper surface rounded downwards at its ends and blending with the lateral discharge holes in such a way that it guides the flow of liquid metal downwards and thus prevents the formation of disturbances in the underlying liquid metal.

According to a variant the upper surface of the bottom end wall comprises distribution means, wedge-shaped means for instance, which distribute the flow of liquid metal towards the two lateral distribution chambers, thus obviating turbulent motions in the liquid metal.

Moreover, so as to improve the mixing of the liquid metal with the liquid metal already in the crystalliser and especially with the liquid metal in the central zone under the bottom end wall of the discharge pipe, the bottom end wall has a convex lower surface, shaped like an arc of a circle, for instance. Furthermore, this convex shape restricts the disturbances, induced by oscillation of the mould, in the molten metal at the meniscus.

According to a variant the bottom end wall of the discharge pipe contains an additional central discharge hole of a size smaller than the lateral discharge holes; through this additional hole the liquid metal is discharged partly in an axial direction into the crystalliser so as to prevent the presence of cold zones beneath the bottom end wall.

Besides, the discharge nozzle according to the invention has, at the zones where the lateral discharge holes are provided, a reduced outer width of about 50 mm. to 150 mm, but advantageously 60 mm. to 120 mm., which enables the liquid metal to run also between the nozzle and the crystalliser so as to ensure a uniform temperature in the whole mass of liquid metal.

According to the invention the upper part of the deflectors is positioned about 100 to 200 mm. below the meniscus.

BRIEF DESCRIPTION OF THE DRAWINGS

The attached figures are given as a non-restrictive example and show a preferred embodiment of the invention as follows.

DETAILED DESCRIPTION OF THE PREFERRED EMBODIMENTS

Figures 1, 2:
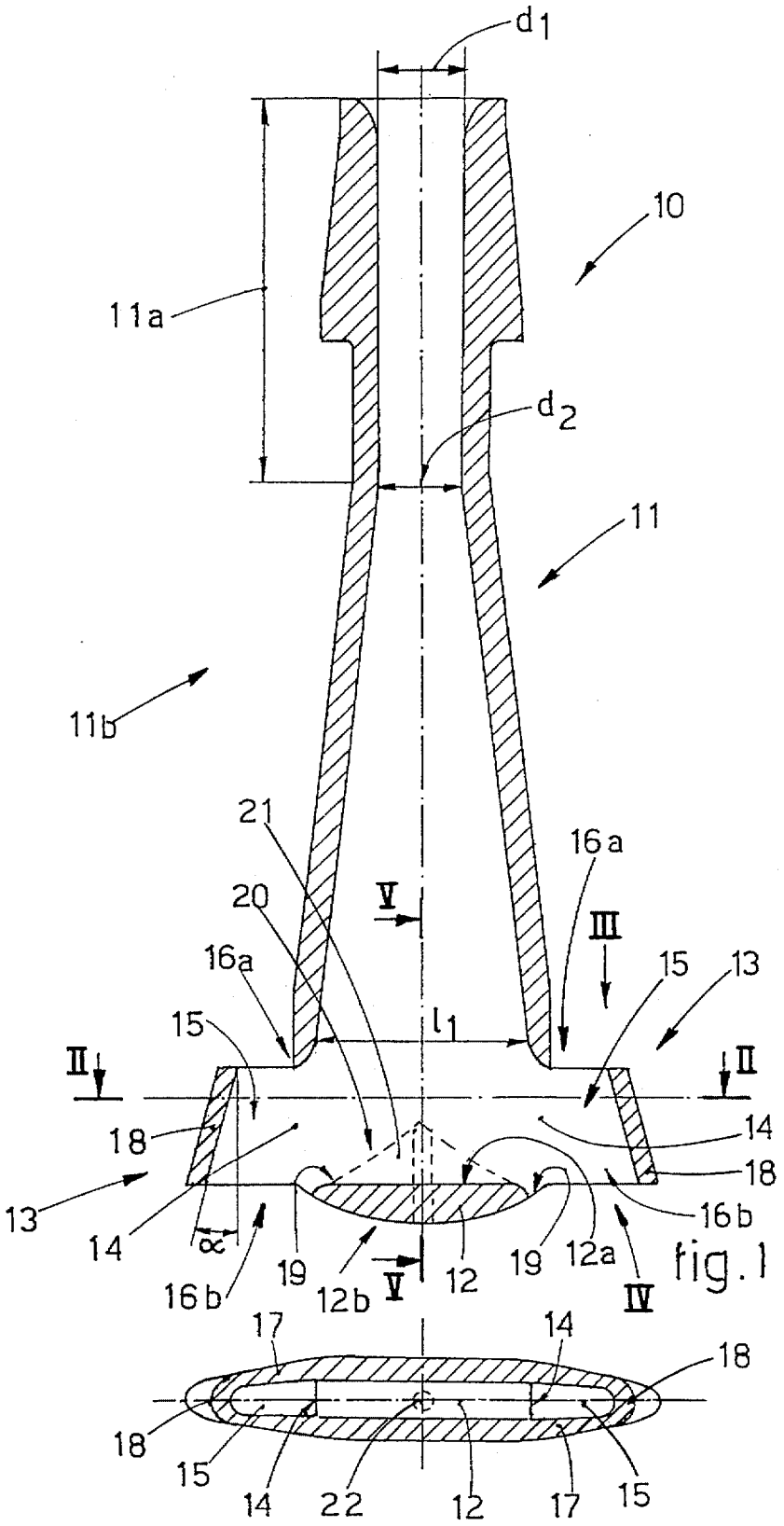
FIG. 1 shows a lengthwise section of a discharge nozzle according to the invention.
FIG. 2 shows a cross-section of the discharge nozzle of FIG. 1 along the line II—II.

The reference number 10 in the attached figures denotes generally a discharge nozzle for continuous casting according to the invention.

The discharge nozzle 10 according to the invention is associated at its upper end with a tundish, which may include a sealing and positioning nozzle and is not shown here, so as to pour liquid metal into a crystalliser of a mould.

The discharge nozzle 10 according to the invention comprises a vertical discharge pipe 11 closed at its lower end by a bottom end wall 12 associated terminally with distribution and deflection means 13.

The discharge pipe 11 contains in its lower portion in cooperation with the bottom end wall 12 and with the distribution and deflection means 13 two lateral opposed discharge holes 14 facing the narrow sides of the crystalliser.

The discharge pipe 11 comprises an upper first segment **11*a* having a downwardly decreasing circular cross-section and extending by about a third of the length of the pipe 11 and a second lower segment 11*b*** having a cross-section progressively variable from circular to substantially rectangular and progressively increasing.

To be more exact, this second segment **11*b*** has the wide side of its rectangular cross-section parallel to the wide sidewall of the crystalliser.

The first segment **11*a*** has a diameter "d1" between 70 mm. and 90 mm., but advantageously 80 mm., at its intake portion and a diameter "d2" between 65 mm. and 85 mm., but advantageously 75 mm., at its outlet.

According to the invention this first segment **11*a*** has an outlet section defined by the diameter "d2" and equal to from 0.84 to 0.92 times the intake section defined by the diameter "d1".

The second segment **11*b*** has, at its outlet, the wide side "1"1 of its rectangular cross-section measuring between 170 mm. and 210 mm., but advantageously 190 mm. and its narrow side measuring between 30 and 42 mm., but advantageously 34 to 38 mm.

According to the invention the outlet of the second segment **11*b* of the discharge pipe 11 has a section which is equal to from 1.1 to 2.1 times the outlet section of the first segment 11*a*** defined by the diameter "d2".

Each distribution and deflection means 13 consists of a distribution chamber 15 associated with a respective discharge hole 14 and stretching in the direction of the wide sidewall of the crystalliser. In this case each distribution chamber 15 has a substantially semi-elliptic section.

Each distribution chamber 15 is open at its upper and lower ends so as to define an upper discharge outlet **16*a* and lower discharge outlet 16*b*** respectively.

Figure 3:
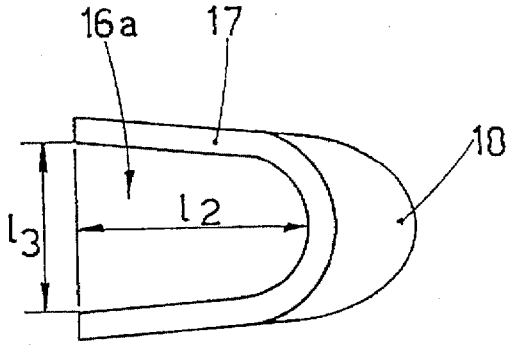
FIG. 3 shows a view in an enlarged scale of the discharge nozzle of FIG. 1 according to the arrow III.

In the discharge nozzle 10 according to the invention (see FIG. 3) the length "1"2 of the upper discharge outlet **16*a* is between 35 mm. and 60 mm. long, but advantageously 45 mm. to 50 mm. long, while the width "1"3 is between 30 mm. and 42 mm. wide, but advantageously 34 mm. to 38 mm. wide, so as to prevent deposits of alumina or other substances being able to block the upper discharge outlet 16*a*** with a resulting solidification of the meniscus.

Figure 4:
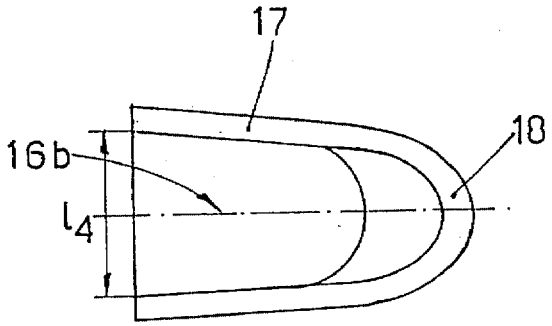
FIG. 4 shows a view in an enlarged scale of the discharge nozzle of FIG. 1 according to the arrow IV.
Figure 5:
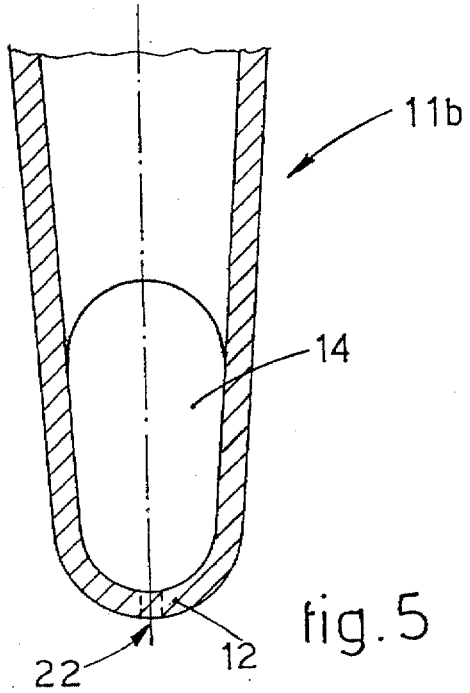
FIG. 5 shows a view in an enlarged scale of a section along the line V—V of the discharge nozzle of FIG. 1.

The lower discharge outlet **16*b* (see FIG. 4**) has a width "1"4 between 25 mm. and 35 mm. wide, but advantageously between 28 mm. and 32 mm. wide.

Each distribution chamber 15 is defined by a sidewall 17 which defines, in relation to the relative lateral discharge hole 14, a deflector 18 that diverges outwards in the downward direction.

The deflector 18 forms with the vertical an angle "α" between 10° and 35°, but advantageously between 15° and 25°.

In this case the sidewalls 17 and, in particular, the deflectors 18 have a height equal to that of the lateral discharge holes 14, and the bottom end wall 12 of the discharge pipe 11 has a length equal to the wide side "1"1 of the outlet of the second segment 11b of the discharge pipe 11.

These geometric characteristics of the discharge nozzle 10 enable the flow Of liquid metal leaving the discharge pipe 11 to be divided into two suitably proportioned streams directed respectively upwards through the upper discharge outlet **16*a* and downwards through the lower discharge outlet 16*b***.

These two streams enable a more uniform temperature of the liquid metal to be attained in the mould and prevent any inclusions in the steel from being wholly incorporated in depth in the slab.

In the discharge nozzle 10 according to the invention the liquid metal leaving the tundish through the discharge pipe 11 slows down progressively in the enlarged cross-section of the second segment 11*b* of the pipe 11, then expands in the distribution chamber 15 and reduces its kinetic energy still further by its impact against the deflectors 18, and thereafter pursues its upward and downward paths.

So as to improve the mixing of the mass of liquid metal in the zone below the bottom end wall 12 and thus to ensure a homogeneous temperature within the liquid metallic mass, the upper surface 12*a* of the bottom end wall 12 includes advantageously, at the sides of the lateral discharge holes 14, rounded chamfered portions 19 to create a lead-in for the liquid metal flowing through the lower discharge outlet 16*b* of the respective distribution chamber 15.

According to a variant shown with lines of dashes in FIG. 1 the upper surface 12*a* of the bottom end wall 12 includes apportioning means 20 consisting in this case of an upward projection 21, which apportions the flow of liquid metal to the two lateral distribution chambers 15 and guides the metal towards the lower discharge outlets 16*b*, thus obviating the formation of disturbances which could impair the solidification process.

Moreover, in this case the bottom end wall 12 has a convex lower surface 12*b* to improve still further the mixing of the liquid mass, to prevent the formation of cold zones and to restrict disturbances of the meniscus caused by oscillation of the mould.

According to a variant the bottom end wall 12 contains a downward axial discharge hole 22, through which a part of the liquid metal passes so as to prevent the formation of cold zones under the bottom end wall 12.

The discharge nozzle 10 according to the invention is applied to crystallisers which can process a range of rates of flow of liquid metal between 1000 and 6500 kgs/min., but advantageously between 1800 and 5500 kgs/min.

We claim:

1. Discharge nozzle for continuous casting of slabs having narrow sides between about 30 and about 300 mm. wide which is employed to distribute liquid metal in a continuous casting mould and is of a type comprising a substantially vertical discharge pipe, which is closed at its lower end and includes lateral terminal discharge holes facing towards the narrow sides of the mould and cooperating with means that distribute and deflect the flow of liquid metal, the discharge nozzle being characterised in that the discharge pipe has an internal flow path which comprises a first segment having a downwardly converging circular cross-section and a second downwardly diverging segment with a cross-section varied progressively from circular to substantially rectangular at least with rounded short sides, the distribution and deflection means consisting of two distribution chambers, one per each lateral discharge hole, the chambers being open at their upper and lower portions and being defined by a sidewall which, at the opposite side of the lateral discharge hole, is confirmed as a downwardly diverging deflector forming an angle "α" with the vertical between 10° and 35°, the lateral discharge holes being adjacent to a bottom end wall and having an overall section about equal to the section of the outlet of the second segment of the discharge pipe, each distribution chamber defining an upper discharge outlet and a lower discharge outlet.

2. Discharge nozzle as in claim 1, in which the first segment having a circular section of the discharge pipe has an outlet section defined by the diameter "d2" and equal to from 0.84 to 0.92 times the intake section defined by the diameter "d1".

3. Discharge nozzle as in claim 1, in which the second segment has an outlet section which is from 1.1 to 2.1 times the outlet section of the first segment.

4. Discharge nozzle as in claim 1, in which the angle "α" has a value between 15° an 25°.

5. Discharge nozzle as in claim 1, in which the bottom end wall of the discharge pipe has a length at least equal to the wide side of the outlet of the second segment of the discharge pipe.

6. Discharge nozzle as in claim 1, in which the deflectors are fitted with their upper end at the same level as the outlet of the second segment of the discharge pipe.

7. Discharge nozzle as in claim 1, in which the deflectors are fitted with their lower end at the same level as the upper part of the bottom end wall.

8. Discharge nozzle as in claim 1, in which the deflectors are fitted at their upper end at the same level as the outlet of the second segment of the discharge pipe and at their lower end at the same level as the bottom end wall.

9. Discharge nozzle as in claim 1, in which each of the upper discharge outlets has a section with a width between 30 and 42 mm. and with a length between 35 and 60 mm.

10. Discharge nozzle as in claim 6, in which each of the lower discharge outlets has a section with a width between 25 and 35 mm.

11. Discharge nozzle as in claim 1, in which the lateral edges of the upper surface of the bottom end wall include at the sides of the distribution chambers downwardly rounded chamfered portions.

12. Discharge nozzle as in claim 1, in which the upper surface of the bottom end wall includes apportioning means including an upward projection.

13. Discharge nozzle as in claim 1, in which the lower surface of the bottom end wall is convex.

14. Discharge nozzle as in claim 1, in which the bottom end wall contains an axial discharge hole.

15. Discharge nozzle as in claim 1, in which the distribution chambers have on the horizontal plane a substantially semi-elliptic section.

16. Discharge nozzle as in claim 1, in which the distribution chambers have on the horizontal plane a section with parallel sides rounded at their ends.

17. Discharge nozzle as in claim 1, in which the distribution chambers have on the horizontal plane a section with outwardly tapered sides.

* * * * *